US008814034B2

(12) United States Patent
Dickie

(10) Patent No.: US 8,814,034 B2
(45) Date of Patent: Aug. 26, 2014

(54) COLLAPSIBLE PAPERBOARD CONTAINER AND A BLANK FOR CONSTRUCTING THE SAME

(75) Inventor: Robert G. Dickie, King (CA)

(73) Assignee: 2224568 Ontario Inc., Toronto, Ontario (CA)

( * ) Notice: Subject to any disclaimer, the term of this patent is extended or adjusted under 35 U.S.C. 154(b) by 646 days.

(21) Appl. No.: 12/325,751

(22) Filed: Dec. 1, 2008

(65) Prior Publication Data

US 2010/0133329 A1 Jun. 3, 2010

(51) Int. Cl.
*B65D 5/36* (2006.01)
*B65D 5/74* (2006.01)
*B65D 5/06* (2006.01)

(52) U.S. Cl.
CPC ..... *B65D 5/068* (2013.01); *B65D 5/746* (2013.01)
USPC ..... 229/117.01; 206/459.5

(58) Field of Classification Search
USPC ..... 229/117.01, 101, 170, 117.08, 117.05; 206/185, 181, 186, 174, 183, 187, 175, 206/180, 193
See application file for complete search history.

(56) References Cited

U.S. PATENT DOCUMENTS

| | | | | | |
|---|---|---|---|---|---|
| 2,400,716 | A | * | 5/1946 | Sattler | 222/107 |
| 2,959,336 | A | * | 11/1960 | Mosse | 229/117.33 |
| 3,366,308 | A | * | 1/1968 | Phillips, Jr. | 229/117.01 |
| 5,848,748 | A | * | 12/1998 | Bouraoui et al. | 229/125.42 |
| 5,975,411 | A | * | 11/1999 | Windolph, III | 229/101 |
| 6,604,674 | B1 | * | 8/2003 | Bowman | 229/116.5 |

* cited by examiner

*Primary Examiner* — Gary Elkins
*Assistant Examiner* — Christopher Demeree
(74) *Attorney, Agent, or Firm* — Sand & Sebolt

(57) ABSTRACT

A collapsible paperboard container and a blank for constructing the same. The container has a bottom wall with a peripheral wall extending upwardly therefrom. A plurality of score lines are provided in the peripheral wall which facilitate movement of this wall from an expanded position to a collapsed position in response to a manual force being applied thereto to cause a first portion of the wall to move toward a second portion thereof. Visual indicators are provided on the container to identify to the consumer where and how to apply manual force to the peripheral wall.

31 Claims, 12 Drawing Sheets

COLLAPSIBLE PAPERBOARD CONTAINER AND A BLANK FOR CONSTRUCTING THE SAME

BACKGROUND OF THE INVENTION

1. Technical Field

This invention generally relates to paperboard containers. More particularly, the invention relates to a paperboard container that can be moved from an expanded position to a collapsed position. Specifically, the invention relates to a paperboard container having a plurality of score lines thereon that permit the container to be collapsed upon application of manual force in specifically indicated locations.

2. Background Information

It is common to provide consumable liquids such as milk and juice in paperboard containers. During the manufacture of the containers, a combination of soft and hard woods are pulped, strained, and pressed into sheets of paperboard. A suitable type of waterproofing material, such as a polyethylene film, is applied to one or both sides of the paperboard. The paperboard is die cut into blanks that are shipped to the dairy or juice manufacturer for filling. At the factory, the blanks are assembled into cartons and are filled with milk or juice. Typically, most of these paperboard containers are thrown away after consumption of the liquids there. Many consumers are unaware of the fact that this type of container is recyclable. Even for those consumers who are aware of the recyclability of these products, disposal of the same is problematic because of the large quantity of empty space the containers occupy in recycling bins. Unlike plastic bottles, which can be somewhat crushed by hand, paperboard milk and juice containers are quite strong and rigid structures that do not crush easily.

There is therefore a need in the art for a collapsible paperboard container that can quickly and easily be collapsed to a reduced size.

SUMMARY OF THE INVENTION

The device of the present invention comprises a collapsible paperboard container and a blank for constructing the same. The container has a bottom wall with a peripheral wall extending upwardly therefrom. A plurality of score lines are provided in the peripheral wall which facilitate movement of this wall from an expanded position to a collapsed position in response to a manual force being applied thereto to cause a first portion of the wall to move toward a second portion thereof. Visual indicators are provided on the container to identify to the consumer where and how to apply manual force to the peripheral wall.

The blank is an improved blank for forming a gable-top paperboard container. The blank is a substantially rectangular sheet of paperboard having a longitudinal axis and a horizontal axis with opposing first and second edges disposed substantially parallel to the horizontal axis and first and second ends disposed substantially parallel to the longitudinal axis, Three longitudinally oriented, spaced apart fold lines are stamped into the sheet and extend between the first and second edges thereby dividing the sheet into four longitudinal panels disposed in a side-by-side horizontal arrangement. Four horizontally oriented fold lines extend between the first and second ends with a first fold line disposed proximate the first end and a second fold line disposed proximate the second end. A third of the horizontal fold line is disposed spaced approximately one quarter of the distance between the first and second ends and adjacent the first fold line; and the fourth horizontal fold line is disposed approximately one quarter of the distance between the first and second ends and adjacent the second fold line. The improved blank further includes a plurality of score lines stamped into the sheet at locations other than on the fold lines. The score lines are provided as lines of weakness to effect collapse of a container produced using the blank upon application of manual force. The blank further includes a plurality of visual indicators one of a front and back surfaces of the blank. These visual indicators are suggestive of areas where manual force should be applied in order to effect collapse of the container.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 6:
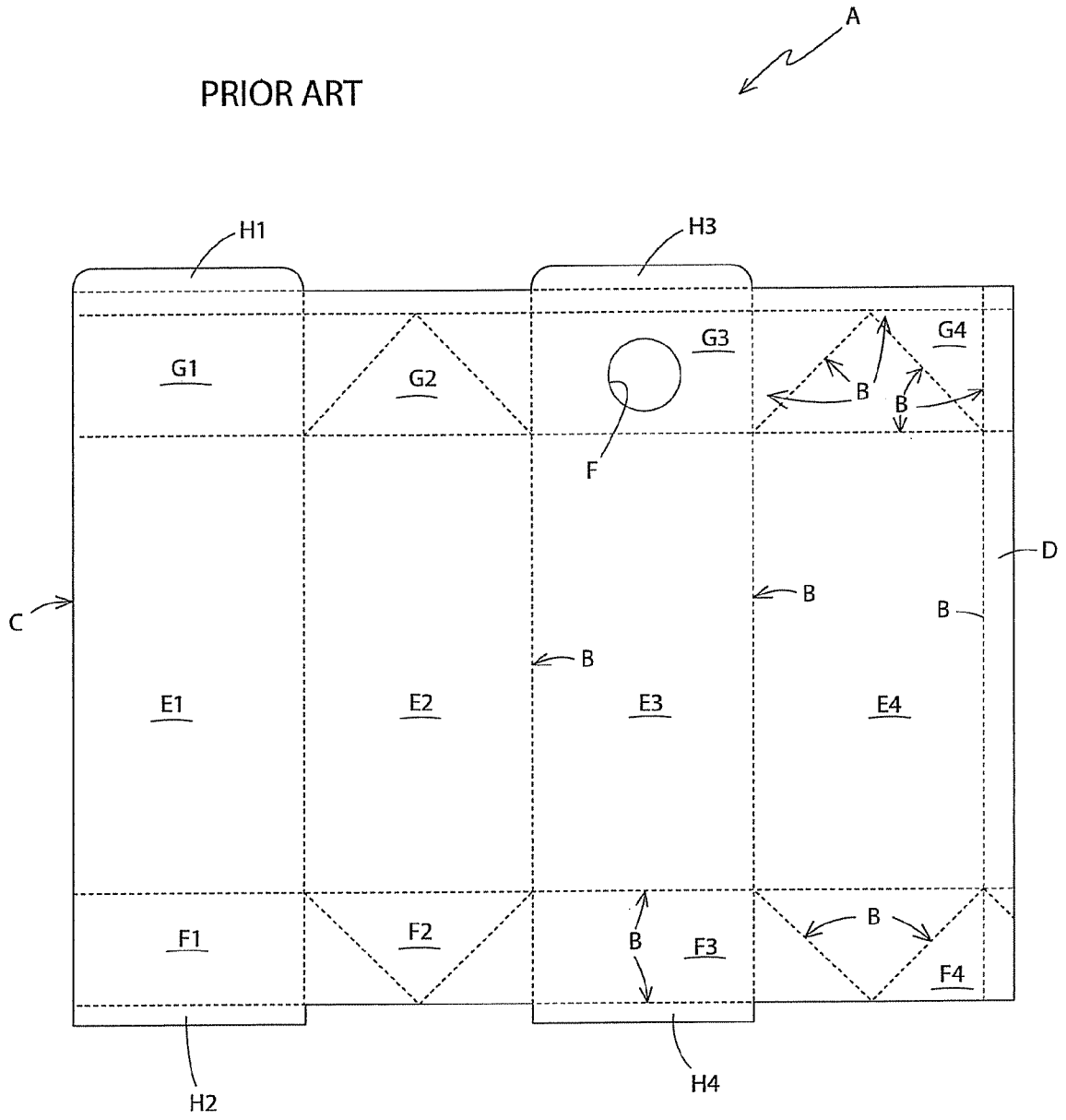
FIG. 6 is a plan view of a blank of a Prior Art paperboard container showing an interior surface and the fold lines formed therein that are used for folding the blank to construct the container.

FIGS. 1-5 show a collapsible paperboard container in accordance with the present invention and generally indicated at 10. Container 10 is designed to retain any suitable substance therein and that substance may include consumable liquids such as milk or juice. Container 10 has the general appearance of what is known in the industry as a gable-topped carton because of the distinctive pattern of the upper end of the container. FIG. 6 shows a blank used in the Prior Art for forming a gable-topped carton. FIG. 7 shows a blank used to form the gable-topped container 10 in accordance with the present invention. FIGS. 8-11 illustrate how container 10 is collapsed after all the contents retained therein have been removed.

Container 10 of the present invention includes a bottom wall 12 (FIG. 4), and a peripheral wall that is integral with the bottom wall 12 and extends upwardly away therefrom. The peripheral wall is comprised of a front panel 14, a pair of opposed side panels 16,18 and a back panel 20. Bottom wall 12 and front, back and side panels 14-20 surround and define an interior chamber 22. Chamber 22 is accessible through an opening in the top end of the peripheral wall. An uppermost portion of each of front panel 14, side panels 16, 18 and back panel 20 is folded inwardly toward a central region to and these uppermost portions are heat sealed together in such a manner as to form the distinctive shape of a gable-topped carton. In the exemplary embodiment, access is provided into interior chamber 22 via an opening 24 defined in front panel 14. A plastic pour spout 26 is secured to front panel 14 and surrounds opening 24. Spout 26 enables a consumer to more easily pour the contents out of container 10. Although not shown in the drawings, a removable seal is engaged in spout 26 immediately after introducing the substance into chamber 22. This ensure that none of the contents of container 10 are accidentally spilled during transport. A removable cap (not shown) is also provided for threadable engagement with spout 26. The seal is removed by the consumer after purchase and the cap is used to retain the contents within the container after that time.

Figure 11:
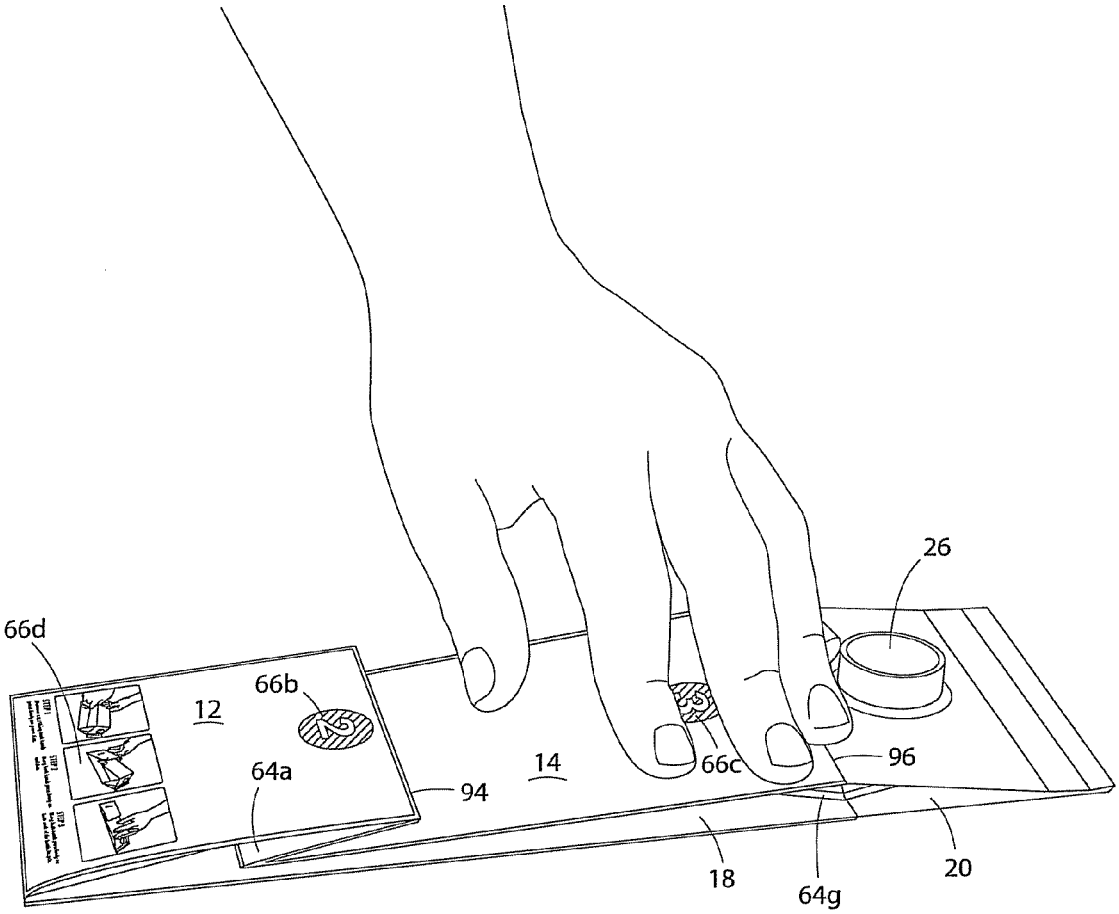
FIG. 11 is a side perspective view of the container showing the container in a fully collapsed position.

In accordance with the present invention, container 10 is designed to be collapsible from an expanded position (FIGS. 1-5) to a collapsed position (FIG. 11) by the application of manual force, specifically by the application of fingertip applied pressure. In the expanded position the container 10 is able to hold a quantity of a substance in its interior chamber 22. When the contents of container 10 have been poured out of spout 26, container 10 may be collapsed so that it is of a reduced volume and therefore occupies substantially less space for either disposal in the garbage or placement in a household recycling container. The internal volume of container 10 is diminished by approximately 75% by moving container 10 from the expanded position (FIG. 1) to the collapsed position (FIG. 11).

In the expanded position, shown in FIGS. 1-5, container 10 is of a height H1 from the sealed tip 28 down to bottom wall 12. Container 10 is further of a width W1 measured between side panel 16 and side panel 18, and is of a depth D1 measured between front panel 14 and back panel 20. Front panel 14, side panels 16, 18 and back panel 20 all have a first section 14*a*, 16*a*, 18*a* and 20*a* that is of a second height H2 (FIG. 2) that is less than H1. A second section of each panel 14*b*, 18*b* and 20*b* is folded so as to angle inwardly toward each other and to form a top end of container 10. It will be understood that a second section of side panel 16 angles inwardly toward second section 18*b* of side panel 18 but is not illustrated in the attached drawings.

FIG. 6 shows the Prior Art blank that is identified by the reference character A. Blank A is die cut from a roll of paperboard that has been coated on both its interior and exterior surfaces with one or more layers of a waterproof plastic such as polyethylene. During manufacture, the paperboard has also had graphic material printed on one side thereof. A die cuts a plurality of blanks A from the roll and, at the same time, stamps a pattern of fold lines B into each blank A, effectively dividing the blank into four panels E1-E4. In FIG. 6, the fold lines B are represented by a plurality of dots. An opening F for a spout is cut into one of the panels, such as E3. The plastic spout (not shown) is inserted and secured in a manner known in the art. The blanks are fed through a sealing machine that folds them laterally along one or two of the fold lines B and creates an overlap between the free end C and the flap D. The overlapped area is heated and squeezed together. The polyethylene in this region melts and bonds the free end C and flap D together, creating a waterproof seam. The blanks are then flattened and shipped to the product manufacturer, such as a dairy or juice production plant. At this location, the flattened blanks A are placed into machinery that opens the blank A, folds a bottom portion F1-F4 of the panels E1-E4 inwardly toward each other and heat seals the same together. Tabs H2 and H4 are also overlapped with portions of the panels E1-E4 during this process and this heat sealed region becomes the bottom wall for the carton. The assembled cartons are then moved to a filling machine that places a premeasured quantity of milk or juice into the interior. The filled cartons are moved into a sealing machine that folds an upper portion G1-G4 of the panels E1-E4 toward each other and overlapping tabs H1 and H3 in such a way as to form the gable-top shape shown in FIG. 1. The sealing machine heats and compresses the appropriate regions of the gable-top to seal the carton.

Figure 7A:
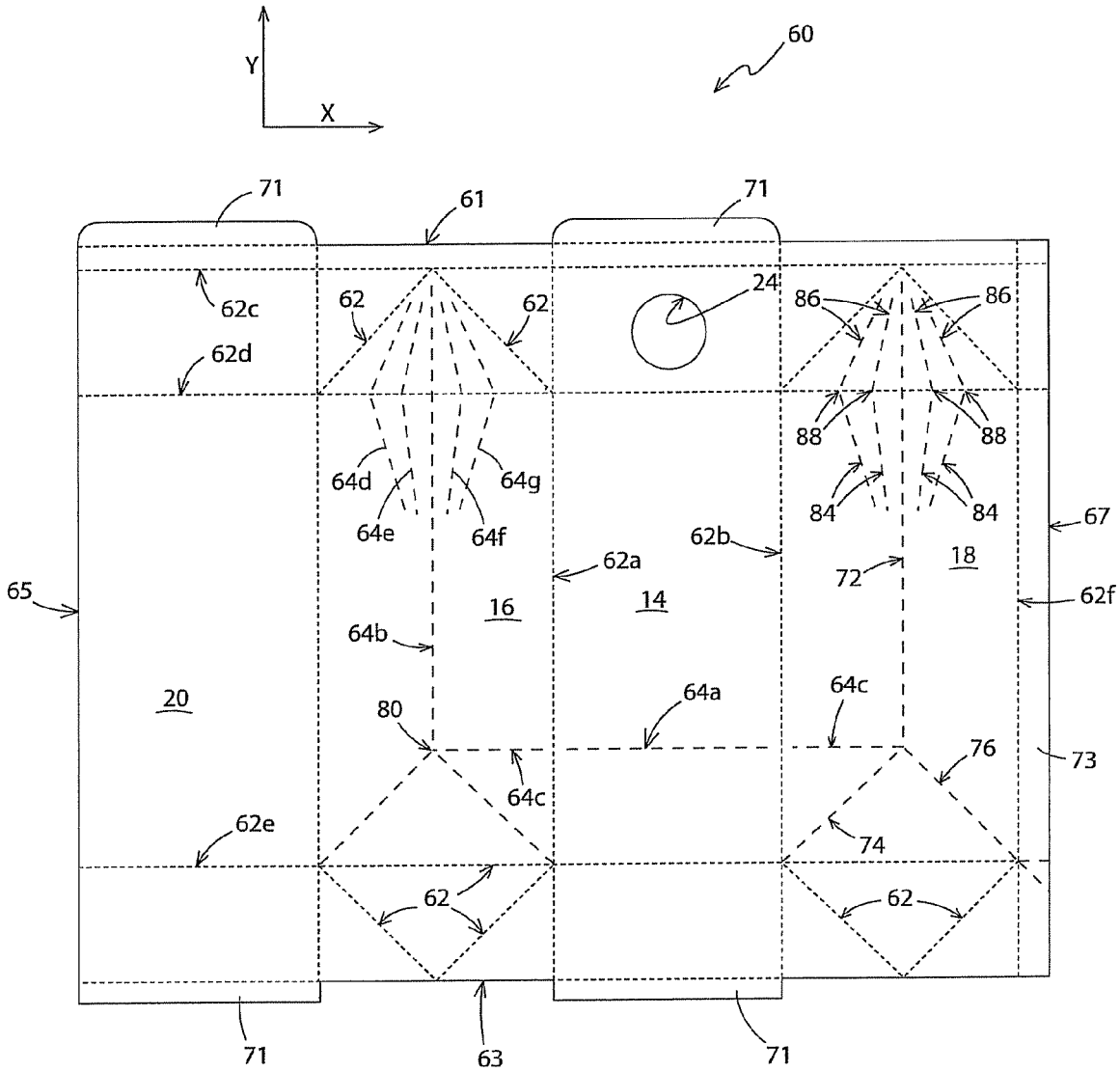
FIG. 7*a* is a plan view of a blank in accordance with the present invention, showing an interior surface thereof and the fold lines formed therein that are used for folding the blank to construct the container, as well as the score lines that are used for collapsing the container once the contents of the container have been removed therefrom.
Figure 7B:
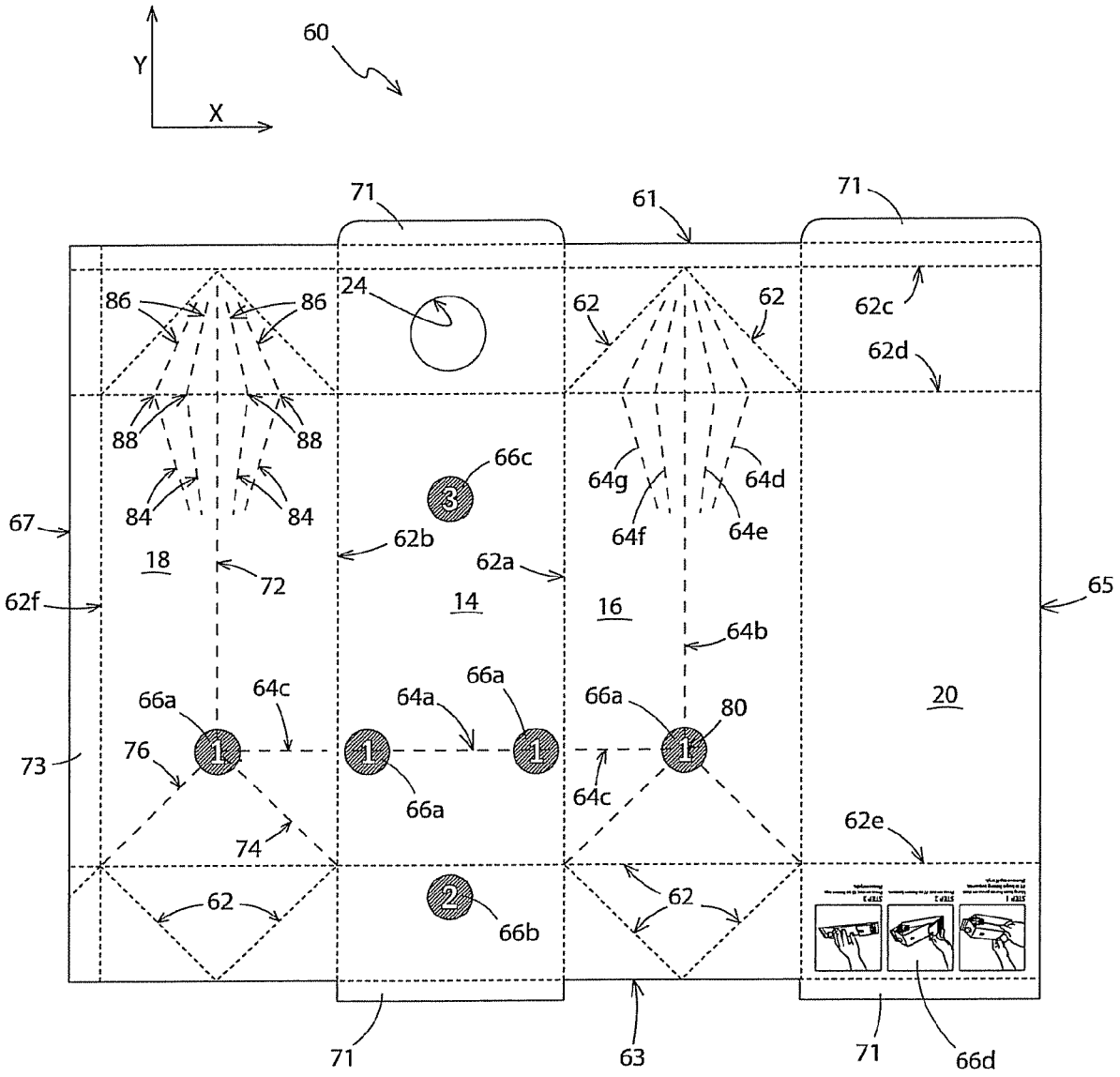
FIG. 7*b* is a plan view of a blank of FIG. 7*a*, showing an exterior surface thereof and the visual indicators that are provided for suggesting where and how to apply manual force to the container constructed therefrom in order to collapse the same.
Figure 8:
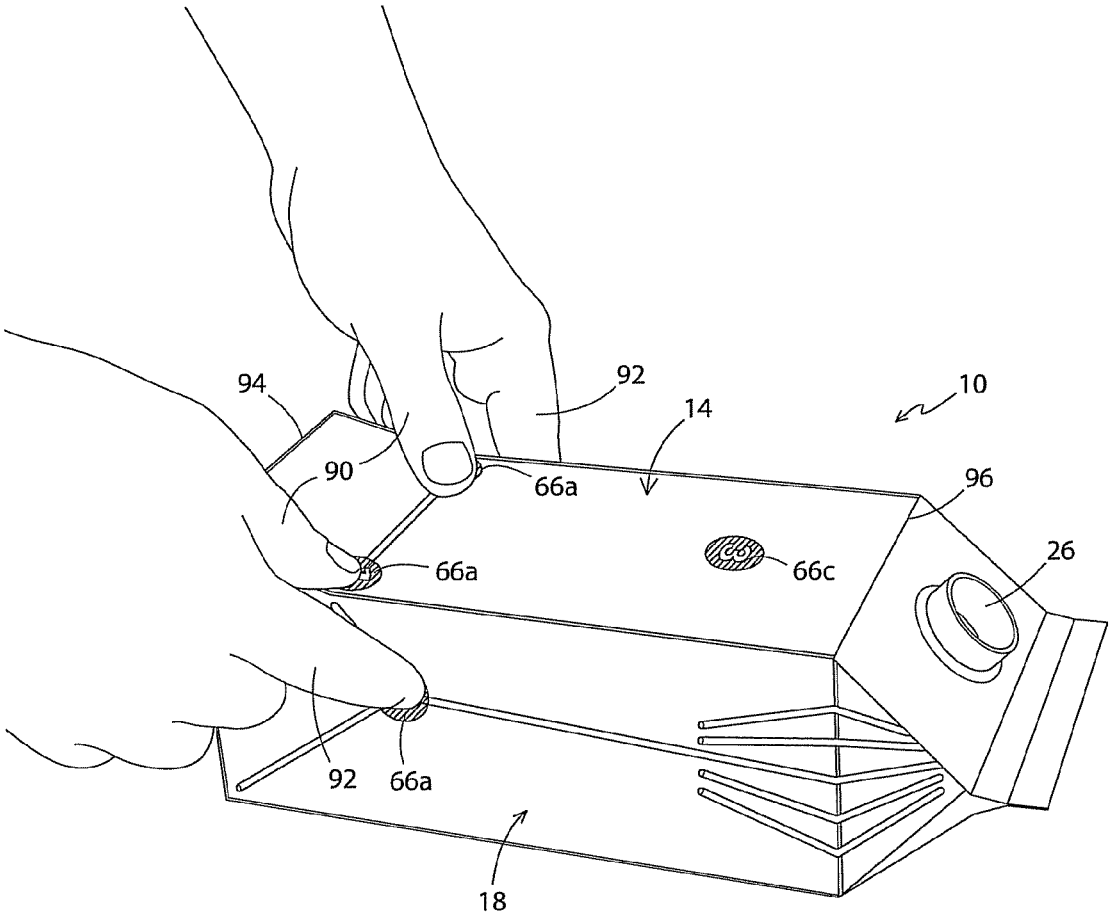
FIG. 8 is a side perspective view of the container showing a person holding the carton and applying fingertip pressure to a first group of the visual indicators to begin the collapse of the container of the bottom and side portions of the containers about the score lines.
Figure 9:
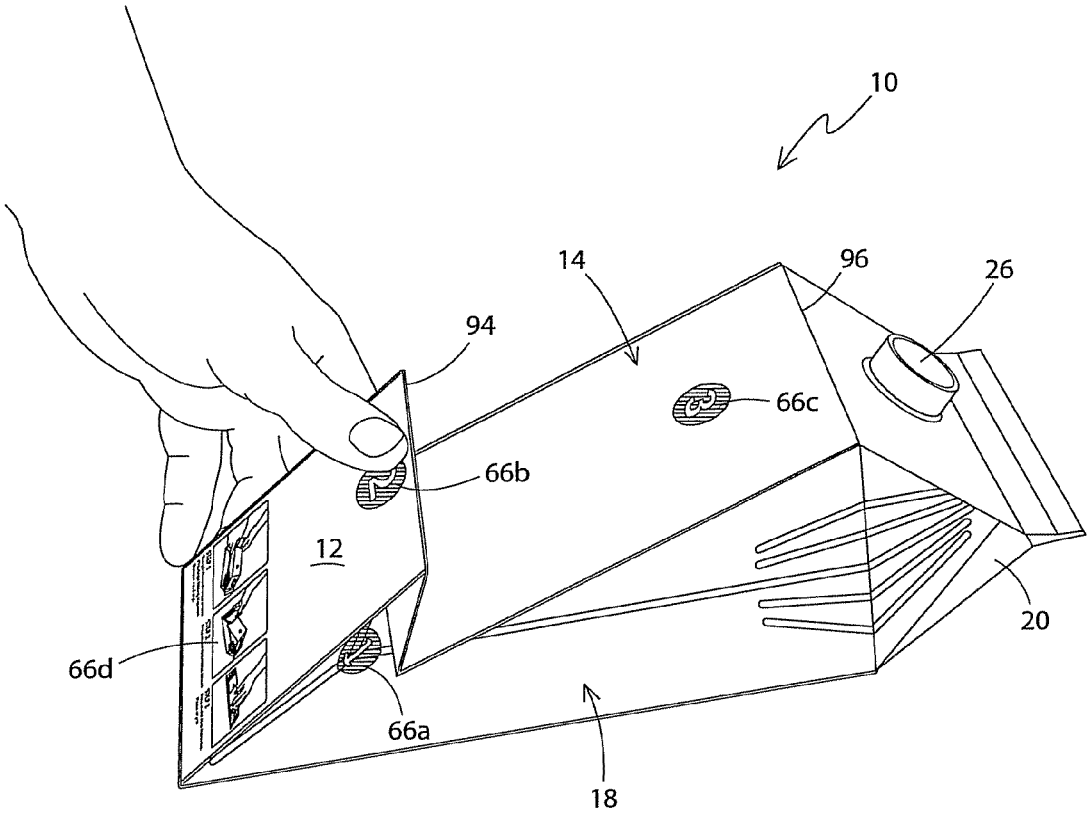
FIG. 9 is a side perspective view of the container showing the bottom thereof being folded onto the front of the container by applying of fingertip pressure to a second group of visual indicators.

FIGS. 7*a* and 7*b* show a blank 60 in accordance with the present invention. Blank 60 is used to manufacture a gable-top container 10 that is collapsible after the contents it carries have been removed. Blank 60 is of generally of the same overall appearance as the blank A of the Prior Art in that it is generally rectangular in shape and has a plurality of fold lines 62 formed therein. Blank 60 has a longitudinal axis "Y" and a horizontal axis "X". Blank 60 further has first and second edges 61, 63 and first and second ends 65, 67. Fold lines 62 are located in substantially the same locations on blank 60 as fold lines B are located on blank A. Fold lines 62 are, once again, represented in this figure by a plurality of dots to indicate that they are substantially identically located and of like nature to the previously known fold lines B made in prior art blank A. Blank 60 is also defined, by fold lines 62, into four, generally rectangular panels. These panels will ultimately form the front panel, back panel and side panels of container 10 and are therefore identified in FIG. 7 as panels 14, 16, 18, and 20, respectively. Panel 14 defines opening 24 therein that spout 26 will be secured into the same manner as opening F and the associated spout would be provided on blank A. A plurality of tabs 71 and the flap 73 are provided on blank 60 to assist in effectively bonding and sealing container 10 during manufacture as was described with reference to Prior Art blank A.

However, in accordance with the present invention, blank 60 differs from the Prior Art blank A in that it also includes a plurality of score lines 64 that are stamped into the blank during manufacture. To differentiate between fold lines 62 and score lines 64, the latter are represented in FIG. 7 by a plurality of dashes. Score lines 64 are stamped into the blank 60 at specific locations that will enable container 10 to be collapsed when empty. Score lines 64 may be stamped into the interior surface 60*a* of blank 60 or into the exterior surface 62*b* thereof, or into both of the interior and exterior surfaces 60*a*, 60*b* as is needed for correct folding of the container 10 as will be hereinafter described. Each score line 64 is a shallow depression that preferably is semi-circular in cross-sectional shape and acts as a zone on the panels 14-20 that permits folding of the panel thereabout. It should be noted that none of score lines 64 fall in the same locations as fold lines 62 and, consequently, none of score lines 64 are used for folding the blank 60 into the gable-top shape during construction of the container 10.

Referring to FIGS. 1, 2, 7*a* and 7*b*, a first score line 64*a* is provided on section 14*a* of front panel 14. Container 10 has a longitudinal axis "Y" (FIG. 2) and first score line 64*a* is disposed at right angles to said longitudinal axis "Y" and therefore substantially parallel to bottom wall 12 of container 10 when container 10 is in a fully expanded position. First score line 64*a* is positioned approximately one quarter of the way up section 14*a* from bottom wall 12 and toward a sealed tip 28 of container 10. Each end of first score line 64*a* preferably is spaced slightly inwardly away from fold lines 62*a*, 62*b* that ultimately form the folded edges 68, 70 of front panel 14.

Figure 1:
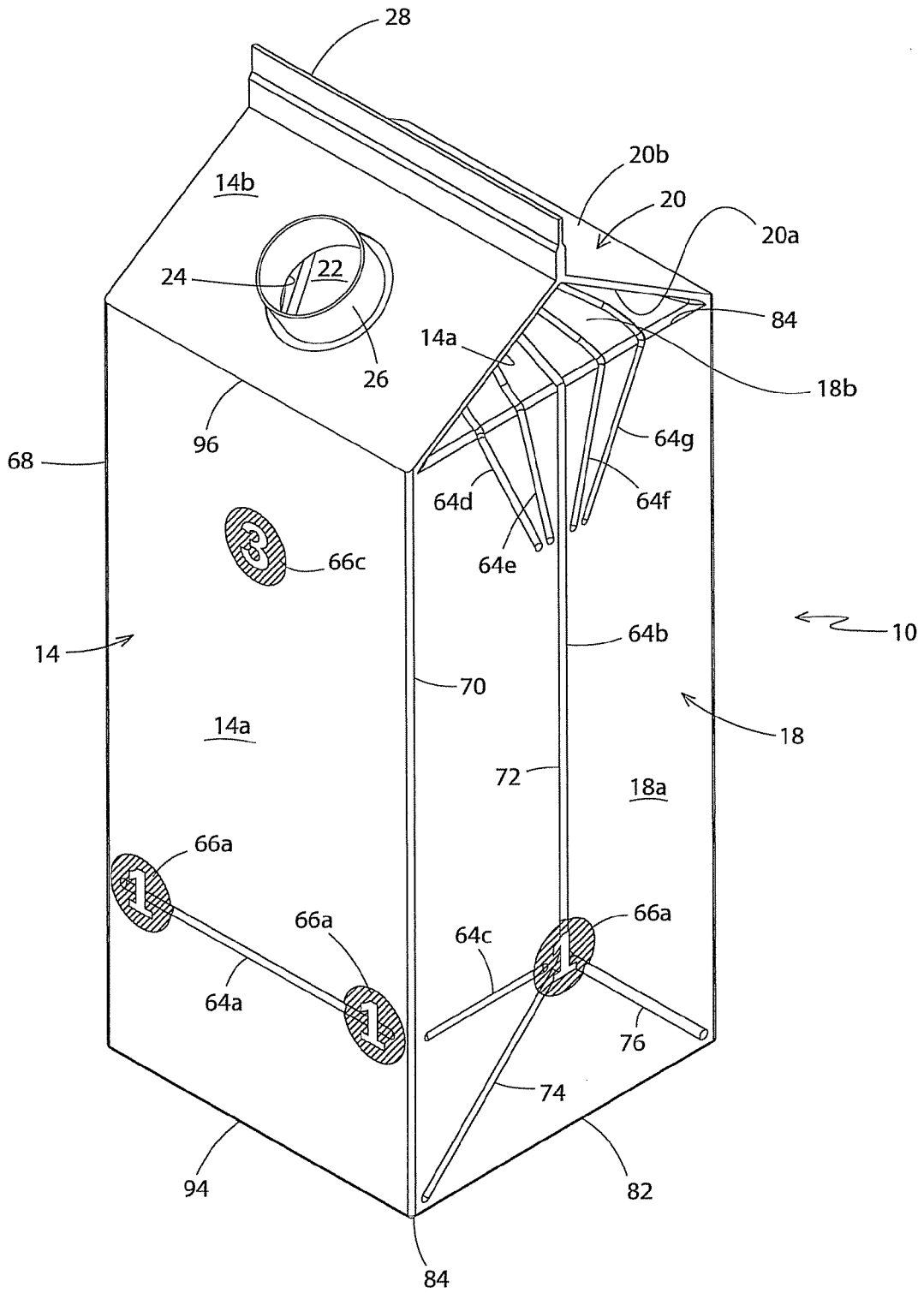
FIG. 1 is a perspective view of a paperboard container in accordance with the present invention and shown in the expanded position.
Figure 2:
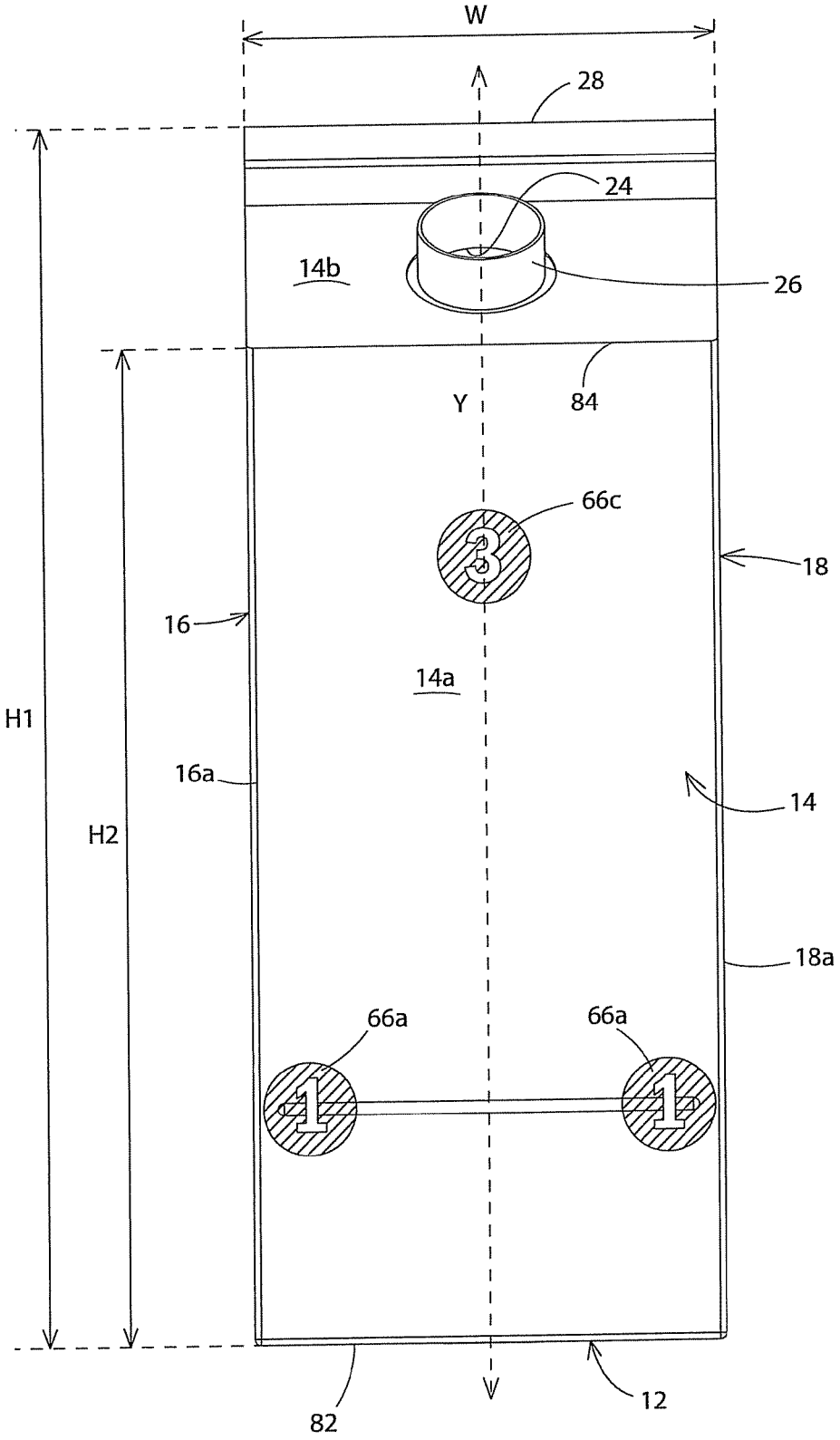
FIG. 2 is a front elevational view of the container of FIG. 1 showing some of the visual indicators thereon.

Still referring to FIGS. 1, 7*a* and 7*b*, a second score line 64*b* is provided on each of side panels 16 and 18. The following description is directed to side panel 18, but it will be understood that it applies equally to side panel 16. Second score line 64*b* comprises a substantially upside-down Y-shaped member having a first arm 72, a second arm first arm 72 and a third arm 76. Referring to FIG. 7, first arm 72 extends generally along a centerline of side panel 18 substantially parallel to the longitudinal axis "Y" of container. First arm originates proximate fold line 62*c*, extends through fold line 62*d* and terminates at a point 80. Point 80 is disposed approximately one quarter of the length of the portion 18*a* of side panel 18 as measured between a fold line 62*e* and fold line 62*d*. Fold line 62*e* is that region of the panel that will constitute a bottom side edge 82 (FIG. 1) of container 10. Second arm 74 extends inwardly from the intersection point of fold lines 62*b*, 62*e*, that will become front bottom corner 84 of container 10, and toward point 80. Second arm 74 preferably is disposed at an angle of 45 degrees relative to fold line 62*e*. Third arm 76 extends inwardly from the intersection of fold lines 62*e* and 62*f*, that will become back bottom corner 86 of container 10, and toward point 80. Third arm 74 preferably is disposed at an angle of 45 degrees relative to fold line 62*e*. Thus, first, second and third arms 72, 74, 76 of score line 64*b* intersect at point 80.

A third score line 64*c* is provided on each of side panels 16, 18. Third score-line 64*c* extends outwardly from intersection point 80 of first, second and third arms 72, 74, 76 of second score line 64*b* and toward first score line 64*a*. Third score line 64 is disposed substantially parallel to bottom wall 12 when container 10 is in the expanded position. Furthermore, third score line 64*c* is substantially co-linear with first score line 64*a*. An end of third score line 64*c* is disposed slightly inwardly from the respective one of fold lines 62*a* and 62*b*. Thus, third score line 64*c* is spaced slightly inwardly away from the associated front edges 68, 70 of container. The lack of a score line intersecting front edges 68, 70 helps container 10 maintain its integrity when full. If the score lines 64 did intersect the fold lines in locations like front edges 68, 70, the regions of intersection might become weakened and lead to the container leaking.

A plurality of fourth score lines 64*d*, 64*e*, 64*f* and 64*g* are provided on each of side panels 16, 18 proximate the outermost end thereof remote from bottom wall 12. Each of the fourth score lines 64*d*-64*g* is substantially V-shaped and comprises a first leg 84 and a second leg 86 that intersect at an apex 88. The apex 88 of each of the fourth score lines intersects fold line 62*d*. Each fourth score line originates proximate a first region of the first arm 72 of first score line 64*b* that is intermediate bottom wall 12 and fold line 62*d* and terminates proximate a second region of first arm 72 that is intermediate fold line 62*d* and fold line 62*c*. The first region of first arm 72 is positioned about one quarter of the length of panel 18*a* inwardly from fold line 62*d*. Fourth score lines 64*e* and 64*f* are shallower V-shapes than are fourth score lines 64*d* and 64*g*. Each leg 84 is disposed at a different angle relative to first arm 72 of second score line 64*b* and first legs 84 radiate outwardly away from second score line 64*b* in such a manner that first arm 72 and first legs 84 form a generally Y-shaped pattern. None of fourth score lines 64*d*-*g* intersect first arm 72 but it will be understood that they could, in fact, do so.

In addition to the score lines 64*a*-64*g*, blank 60 of the present invention further differs from the Prior Art blank A in that a plurality of visual indicators 66 are provided on the exterior surface 60*b* thereof. Visual indicators 66 are provided for two reasons. Firstly, they attract the consumer's attention and, when investigated by reading the bottom wall, teach the consumer that the container 10 may be recycled. Secondly, they teach that the container is collapsible for the purposes of either recycling or disposal. Thirdly, they provide specific instruction on how to collapse the container 10.

Visual indicators 66 are provided to suggest to the consumer that they may apply pressure to container 10 to move it from an expanded position to a collapse position. Visual indicators 66 identify regions on the container 10 where a consumer should apply fingertip pressure in order to collapse the container 10 when empty. Application of fingertip pressure in these particularly indicated regions will cause one of the panels in the peripheral wall to move toward one of the other panels, thereby altering the dimensions of the container. It should be noted that movement of the container 10 from an expanded position to a collapsed position is effected without breaking any of the seals that were formed during production of the container. So, for example, the seam formed by overlapping and heat sealing a portion of back panel 20 with side panel 18 is unaffected by the collapse. There is therefor no need for the consumer to "break down" the emptied container 10 by opening any of those heat sealed seams before collapsing the container.

Visual indicators 66 can be of any nature that is readily understandable by the consumer. So, as illustrated in FIGS. 1-5 for example, a first group of visual indicators 66*a* includes a graphic of the number "1", a second group 66*b* includes a graphic of the number "2" and a third group 66*c* includes a graphic of the number "3". These characters indicate in what order pressure should be applied to container 10. The visual indicators 66 are made further understandable by provision of a fourth visual indicator 66*d* that is imprinted on a portion of one or more of the regions of the panels 14-20 that will form the bottom wall 12 of container 10. The visual indicator 66*d* on these portions is a printed detailed instruction panel that visually and textually shows the consumer how to hold container 10 and how to collapse the same once empty by applying pressure in certain locations.

Figure 10:
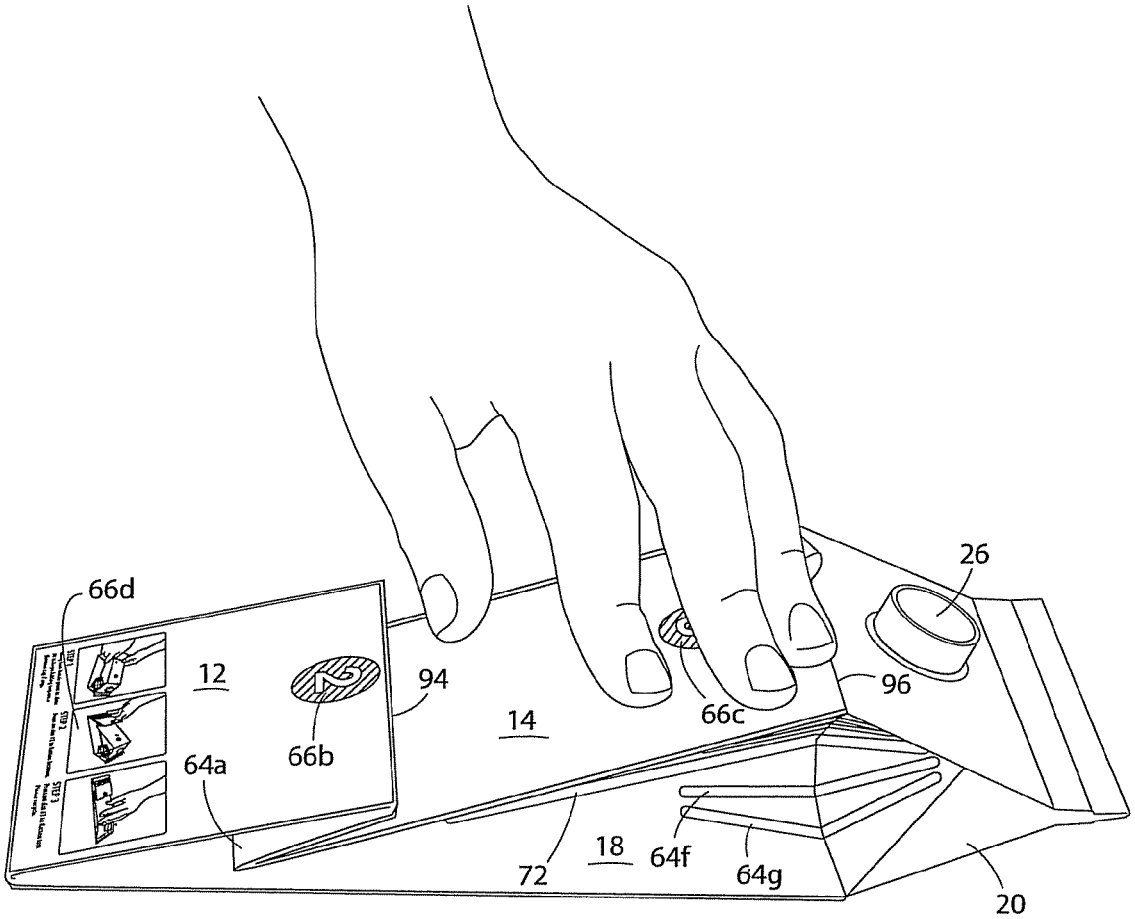
FIG. 10 is a side perspective view of the container showing application of fingertip pressure to the front of the carton to collapse the front thereof onto the back thereof.

Container 10 is expanded to receive and retain a substance therein, such as juice or milk, in substantially the same manner as gable-topped cartons manufactured from the prior art blank A. However, container 10 is, unlike the prior art cartons, able to be collapsed when empty so as to occupy a smaller volume of space for disposal or recycling purposes. Container 10 is collapsed, once chamber 22 is emptied of its contents, in the manner illustrated in FIGS. 8 through 11. Firstly, if container 10 is as shown in FIGS. 1-5, the cap (not shown) that is used to seal spout 26 is removed and disposed or recycled separately. The container 10 is then placed on a flat and preferably rigid surface so that back panel 20 abuts this surface. The consumer then places a thumb 90 on each of the visual indicators 66*a* on front panel 14 and an index finger 92 on each of the visual indicators 66*a* on side panels 16, 18. The consumer applies downward and inward pressure on panels 14, 16 and 18, respectfully, by way of their thumbs 90 and index fingers 92. This pressure causes front panel 14 to fold about first score line 64*a* and move inwardly toward the interior of back panel 20. Additionally, the pressure causes the lower regions of side panels 16, 18 to begin to fold inwardly along second score lines 64*b* and toward each other. At this point, side panels 16, 18 are no longer orthogonal to bottom wall 12 as was the case when container 10 was fully expanded. Furthermore, the bottom front edge 94 of front panel 14 moves upwardly toward top front edge 96 of front panel 14 so that the distance between these two locations is reduced, This may be seen in FIG. 9. The consumer then applies pressure to the bottom wall in the region of the second visual indicator 66*b* by pushing downwardly on indicator 66*b*. This causes front panel 14 to fold about first score line 64*a* so that a first portion of the exterior surface of front panel 14 abuts a second portion of the exterior surface of front panel 14 (FIG. 10). The consumer then applies finger pressure to container 10 in the region of the third visual indicator 66*c* and pushes downwardly on the upper portion of front panel proximate edge 96. This pressure causes side panels 16, 18 to fold about score lines 64*d-g* from the position shown in FIG. 10 to the position shown in FIG. 11.

Figure 3:
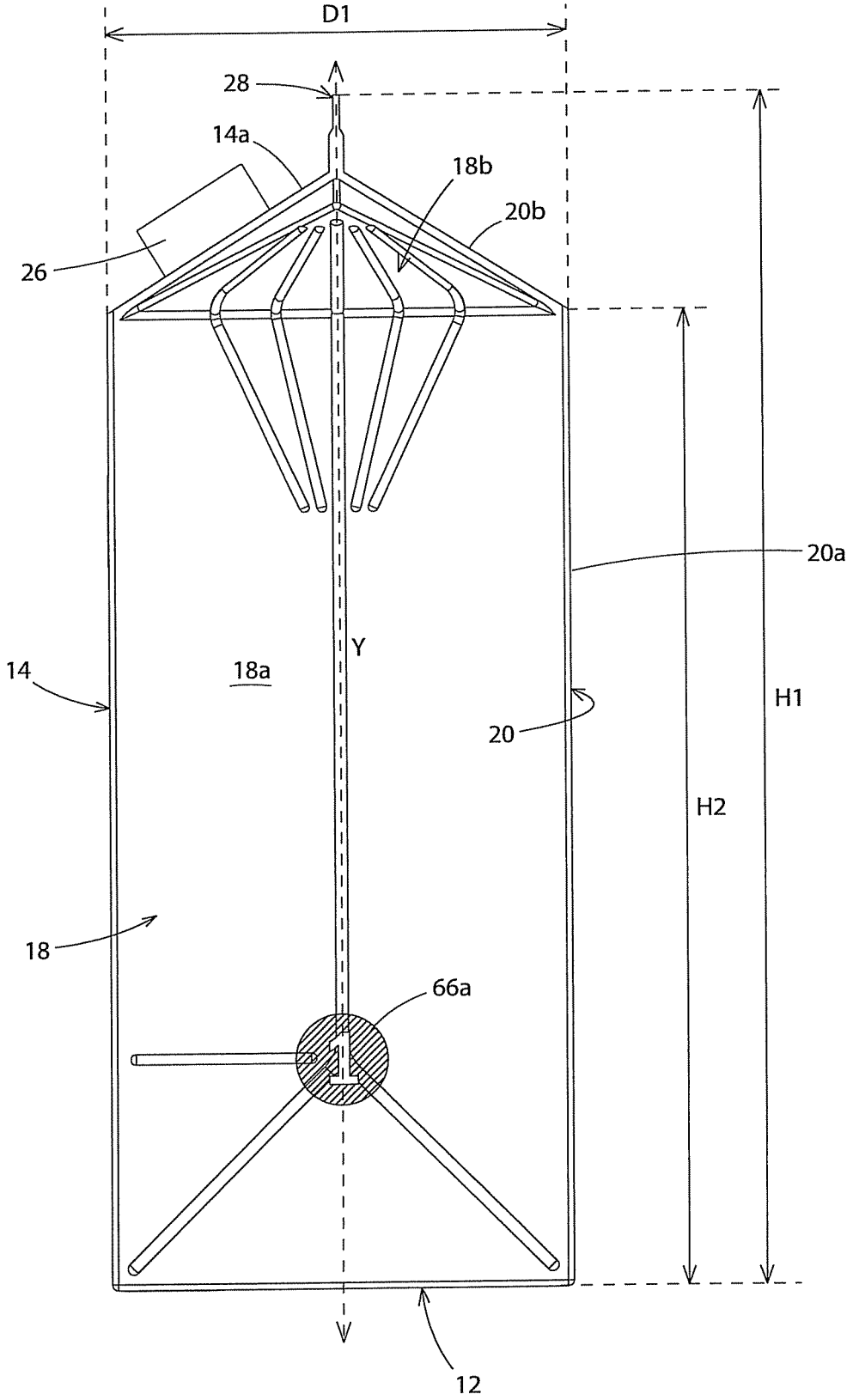
FIG. 3 is a side elevational view of the container showing other of the visual indicators and showing some of the score lines about which the container is collapsible.
Figure 4:
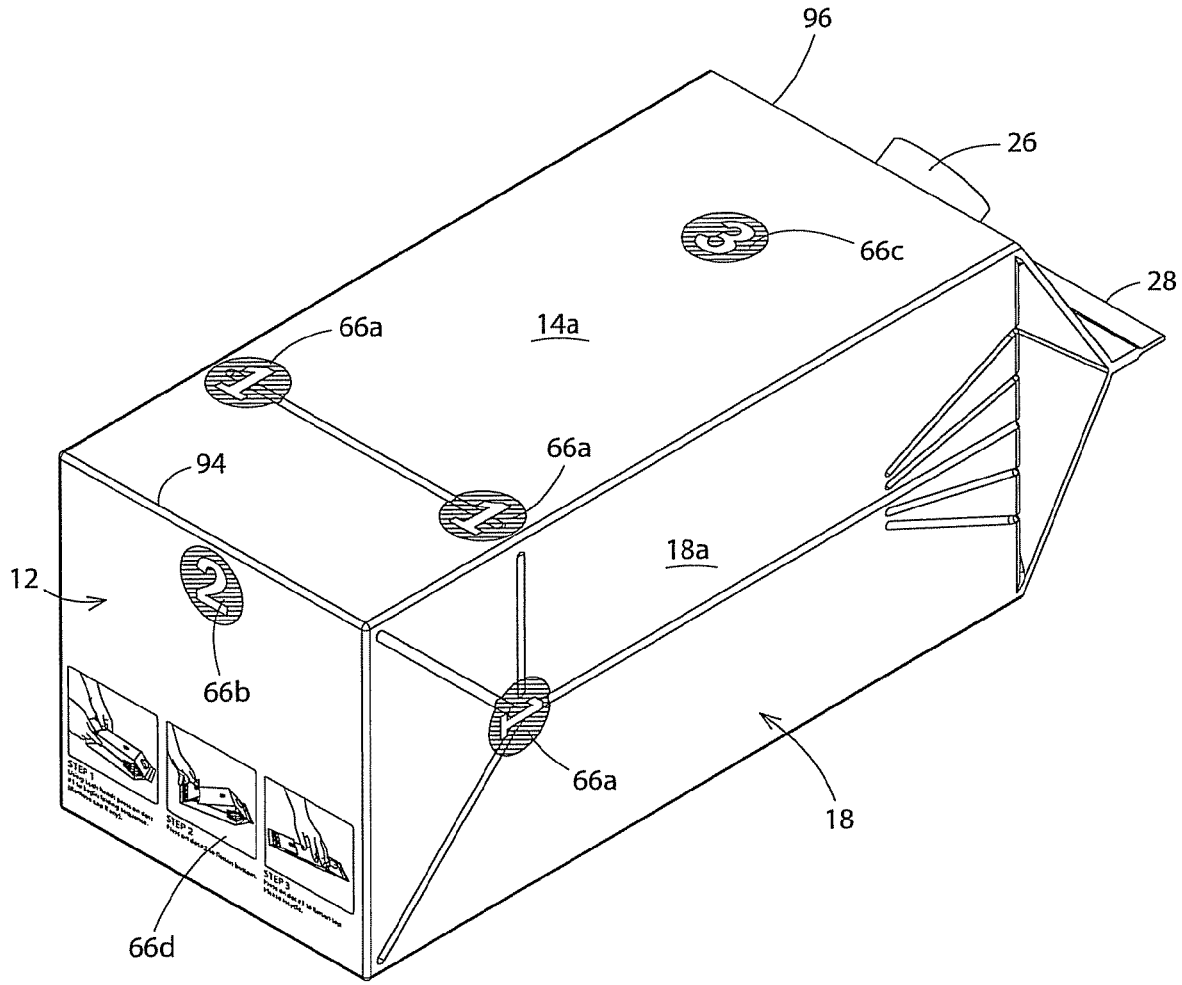
FIG. 4 is a perspective view of the container shown laying on its back to show yet other of the visual indicators thereon.
Figure 5:
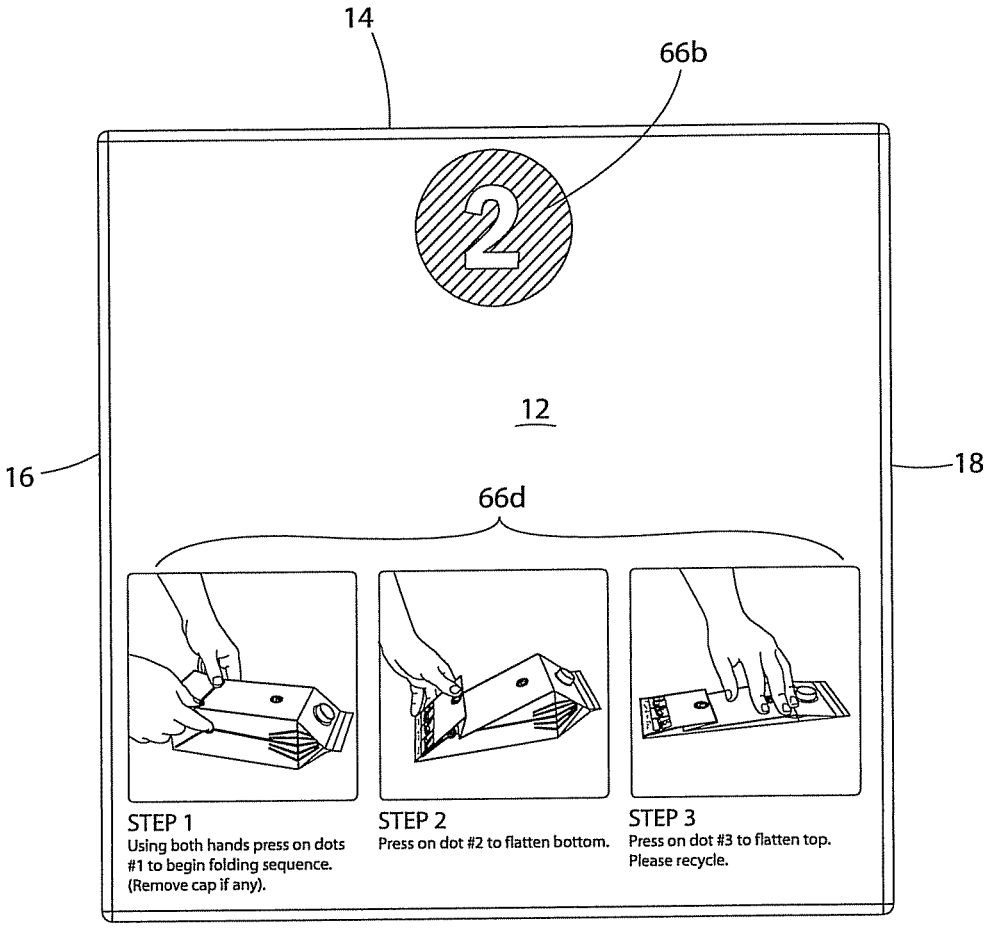
FIG. 5 is a bottom view of the container of FIG. 1 showing one of the visual indicators thereon together with the instructions as to how to fold the carton imprinted thereon.

As is clearly evident from FIGS. 3 and 11, the depth of container 10 changes dramatically from D1 in an expanded position, to D2 in a collapsed position. D2 is substantially smaller than D1. The width W1 of the container remains substantially unchanged as does the height H1 thereof. Consequently, the overall volume, which is calculated as height×depth×width, is greatly reduced when container 10 is collapsed. It is estimated that the volume of the collapsed container is reduced by approximately 75% from that of the expanded container. The lower profile and substantially flattened container is more readily disposed of in either of a garbage container or a recycling container.

It will be understood that while container 10 is shown to have an opening 24 and spout 26 in front panel 14, container 10 may, alternatively, be provided without the opening 24, the spout 26 and the associated seal and cap, and may, instead, be opened by pulling outwardly on the side edges 14*a*, 20*a* (FIG. 1) of front and back panels 14, 20 to break the seal between the two and permit the upper portion of side panel 18 to be pulled outwardly into a position where it forms a spout for dispensing the liquid from chamber 22.

It should be noted that the score lines 64 are provided in locations that permit container 10 to be collapsed only in a single direction, i.e., the front panel 14 being pushed downwardly onto the interior surface of the back panel 20, with the side panels 16, 18 being folded thereinbetween. While it would be possible to provide score lines that would permit collapse in a variety of different directions, the quantity and placement of the visual indicators 66 that would be have to be provided to show the consumer how to effect these collapses, would be excessively complicated. This would likely cause the average consumer to be temporarily overwhelmed and therefore less likely to try and collapse the container.

It will further be understood that while the container 10 is shown as collapsing so that the front panel folds onto the back panel with the side panels being captured thereinbetween, container 10 may be collapsed in any one direction without departing from the spirit of the present invention.

It will still further be understood that while a gable-top container is illustrated as embodying the present invention, other shaped paperboard containers could be provided with appropriate score lines and visual indicators to aid in collapsing those containers to reduce their overall volume for recycling or disposal. So, for example, a container such as a juice box that is substantially rectangular in shape, could be provided with appropriate score lines and visual indicators that would enable it to be collapsed to reduce its overall volume.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A collapsible paperboard container comprising:

a bottom wall;

a peripheral wall having a front panel, a back panel, and opposing side panels, the peripheral wall being connected at a bottom end to the bottom wall and extending upwardly therefrom, and which has expanded and collapsed positions, the container having a longitudinal axis whereby the bottom wall is disposed at right angles to the longitudinal axis when the container is in the expanded condition;

an interior chamber defined by the bottom wall and peripheral wall;

a top entrance opening of the interior chamber defined by a top of the peripheral wall;

a plurality of score lines formed in the peripheral wall which facilitate movement of the peripheral wall from the expanded position to the collapsed position in response to a manual force being applied to the peripheral wall to cause a first portion thereof to move toward a second portion thereof, the plurality of score lines comprising:

a first score line provided in the front panel and disposed substantially orthogonally to the longitudinal axis, the first score line being positioned within a bottom third of the container; and a second score line formed in each of the side panels, said second score lines being substantially mirror images of each other and each comprising a substantially V-shaped member having a first arm disposed substantially parallel to a longitudinal axis of the container, a second arm extending from proximate a bottom front corner of the side panel and toward the first arm, and a third arm extending from proximate a bottom back corner of the side panel and toward the first arm, said first, second and third arms intersecting at a point; and a plurality of visual indicators provided at positions of the container so as to indicate where and in what order manual force should be applied to collapse the container along the score lines by visually identifying positions on the container where fingertip pressure should be applied to collapse the container and the order in which said pressure should be applied to said positions, the visual indicators comprising:

a plurality of first alphanumeric markings identifying positions for a first application of fingertip pressure to a first score line on the front panel and the second score lines on the side panels, the first alphanumeric markings being disposed at each end of the first score line and at the point of intersection of the second score lines on each respective side panel;

at least one second alphanumeric marking identifying a position for a second application of fingertip pressure to the bottom wall, the second alphanumeric marking being disposed laterally centrally along the front edge of the bottom wall; and at least one third alphanumeric marking identifying a position for a third application of fingertip pressure to the front panel, the third alphanumeric marking being disposed laterally centrally in an upper portion of the front panel, the visual indicators thereby being respectively positioned on the container at said positions where the indicators instruct that fingertip pressure should be applied to collapse the container.

2. The collapsible paperboard container as defined in claim 1, wherein movement of the peripheral wall from the expanded to the collapsed position causes one of the front, back and side panels to move toward another of the front, back and side panels.

3. The collapsible paperboard container as defined in claim 2, wherein the movement of the peripheral wall from the expanded to the collapsed position causes one of the front and back panels to move toward the other of the front and back panels and further causes one of the side panels to move toward the other side panel.

4. The collapsible paperboard container as defined in claim 2, wherein at least two of the front, back and side panels are secured together to form a seam; and wherein movement of the peripheral wall from the expanded position to the collapsed position is effected without the seam being broken.

5. The collapsible paperboard container as defined in claim 1, wherein each of the plurality of score lines comprises a substantially shallow channel formed in the peripheral wall and about which the peripheral wall folds upon application of manual force.

6. The collapsible paperboard container as defined in claim 1, wherein the front panel has a first longitudinal edge where it joins a first side panel and a second longitudinal edge where it joins a second side panel, and wherein the first score line extends from proximate the first edge to proximate the second edge.

7. The collapsible paperboard container as defined in claim 6, wherein the first score line originates a spaced distance inwardly from the first longitudinal edge and terminates a spaced distance inwardly from the second longitudinal edge.

8. The collapsible paperboard container as defined in claim 1, wherein each of the second and third arms of the second score line is disposed at an angle of forty-five degrees relative to the bottom wall of the container when in the expanded position.

9. The collapsible paperboard container as defined in claim 8, further comprising a third score line provided on each of the side panels; said third score line extending forwardly from the intersection point and orthogonally to the longitudinal axis of the container to a position proximate an associated one of the first and second longitudinal front edges of the side panel.

10. The collapsible paperboard container as defined in claim 9, wherein the third score lines are each substantially co-linear with the first score line.

11. The collapsible paperboard container as defined in claim 1, wherein the first arm is disposed substantially along a centerline of the side panel and extends from proximate an outer end of the side panel to the intersection point that is spaced a distance inwardly from the bottom wall of the container.

12. The collapsible paperboard container as defined in claim 1, wherein the plurality of score lines comprises a plurality of fourth score lines provided in each of the side panels and proximate the outer end thereof remote from the bottom wall; and wherein each of the fourth score lines is substantially V-shaped.

13. The collapsible paperboard container as defined in claim 12, wherein each of the fourth score lines originates proximate a first region of the second score line and terminates proximate a second region of the second score line remote from the first region thereof.

14. The collapsible paperboard container as defined in claim 13, wherein each of the fourth score lines comprises a first leg and a second leg that intersect at an apex, and wherein the apices of all of the fourth score lines intersect a fold line that forms an upper edge of the side panel when the container is in the expanded position.

15. The collapsible paperboard container as defined in claim 1, wherein are provided on each of the side panels at the intersection point of the first, second and third arms of the second score line.

16. The collapsible paperboard container as defined in claim 15, wherein each of the first markings includes the number one.

17. The collapsible paperboard container as defined in claim 16, wherein the second marking includes the number two.

18. The collapsible paperboard container as defined in claim 17, wherein the third marking includes the number three.

19. The collapsible paperboard container as defined in claim 18, wherein the visual indicator further includes a fourth marking disposed on anyone of the front, back and side panels, and wherein the fourth marking includes one or both of a series of graphic images and text suggestive of instructions as to how to collapse the container by applying manual force.

20. An improved blank for forming a gable-top paperboard container, wherein the blank is a substantially rectangular sheet of paperboard having a longitudinal axis and a horizontal axis with opposing first and second edges disposed substantially parallel to the horizontal axis and first and second ends disposed substantially parallel to the longitudinal axis; wherein said blank further includes three longitudinally oriented, spaced apart fold lines stamped into the sheet and extending between the first and second edges, said fold lines dividing the sheet into four longitudinal panels disposed in a side-by-side horizontal arrangement wherein the four longitudinal panels will form a front panel, a back panel and opposing side panels of a container constructed from the blank; and four horizontally oriented fold lines extending between the first and second ends, wherein a first horizontal fold line is disposed proximate the first end and a second fold line is disposed proximate the second end; and a third fold line is disposed spaced approximately one quarter of the distance between the first and second ends and adjacent the first fold line; and a fourth fold line is disposed approximately one quarter of the distance between the first and second ends and adjacent the second fold line; and wherein the improvement comprises:

a plurality of score lines stamped into the sheet at locations other than on the fold lines, said score lines being provided as lines of weakness to effect collapse of a container produced using the blank upon application of manual force, the plurality of score lines comprising:

a first score line provided in the front panel and disposed substantially orthogonally to the longitudinal axis, the first score line being positioned within a bottom third of the container; and a second score line formed in each of the side panels, said second score lines being substantially mirror images of each other and each comprising a substantially V-shaped member having a first arm disposed substantially parallel to a longitudinal axis of the container, a second arm extending from proximate a bottom front corner of the side panel and toward the first arm, and a third arm extending from proximate a bottom back corner of the side panel and toward the first arm, said first, second and third arms intersecting at a point; and a plurality of visual indicators provided at positions of a front surface of the blank so as to indicate where and in what order manual force should be applied in order to effect collapse of the container along the score lines by visually identifying positions on the container where fingertip pressure should be applied to collapse the container and the order in which said pressure should be applied to said positions, the visual indicators comprising:

a plurality of first alphanumeric markings identifying positions for a first application of fingertip pressure to a first score line on the longitudinal panel that will form the front panel and the longitudinal panels that will form the opposing side panels, the first alphanumeric markings being disposed at each end of the first score line and at the point of intersection of the second score lines on each respective side panel;

at least one second alphanumeric marking identifying a position for a second application of fingertip pressure to the longitudinal panel that will form the front panel located between the second and fourth fold lines, the second alphanumeric marking being disposed laterally centrally along the score line that will form the front edge of the bottom wall; and at least one third alphanumeric marking identifying a position for a third application of fingertip pressure to the longitudinal panel that will form the front panel located proximate to the third fold line, the third alphanumeric marking being disposed laterally centrally in an upper portion of the longitudinal panel that will form the front panel, the visual indicators thereby being respectively positioned on the container at said positions where the indicators instruct that fingertip pressure should be applied to collapse the container.

21. The blank as defined in claim 20, wherein the plurality of score lines includes the first score line stamped into a first one of the panels that is adapted to become the front panel of the container constructed from the blank, said first score line being oriented substantially parallel to the horizontal axis and intermediate the third and fourth horizontal fold lines, said score line being disposed closer to the fourth score line than to the third.

22. The blank as defined in claim 21, wherein the first markings are disposed one at either end of the first score line.

23. The blank as defined in claim 22, wherein the ends of the first score line are disposed inwardly of a pair of the longitudinal fold lines that define the first panel.

24. The blank as defined in claim 22, wherein the plurality of score lines further includes a second score line defined in each of a second and third panel disposed on either side of the first panel; and wherein the second score lines are substantially identical and each include:

a substantially V-shaped member having:

a first arm disposed substantially parallel to the longitudinal axis of the blank and along a centerline of said one of the second and third panels;

a second arm extending from a region proximate an intersection of the fourth horizontal fold line with one of the longitudinal fold lines that defines the one of the second and third panels and toward said first arm; and a third arm extending from a region proximate an intersection of the fourth horizontal fold line with the other of the longitudinal fold lines that defines the one of the second and third panels, and toward said first arm, whereby said first, second and third arms intersect at an intersection point.

25. The blank as defined in claim 24, wherein the plurality of score lines further includes a third score line formed in each of the second and third panels, wherein said third score line extends from the intersection point toward the first panel, said third score line being co-linear with the first score line.

26. The blank as defined in claim 25, wherein the plurality of score lines further includes a plurality of fourth score lines formed in each of the second and third panels, each of said fourth score lines being disposed at an opposite region of the second score line from the first and second arms; and wherein each of the fourth score lines is substantially V shaped and comprises a first leg and a second leg that intersect at an apex.

27. The blank as defined in claim 26, wherein the apices of each of the fourth score lines are disposed on the third horizontal fold line and the first leg extends from the third horizontal fold line toward the first arm of the second score line at a first region proximate the first edge of the blank; and the second leg extends from the third horizontal fold line toward the first arm of the second score line at a second region disposed intermediate the third and fourth horizontal fold lines.

28. The blank as defined in claim 27, wherein the plurality of visual indicators includes first markings disposed at the intersection point on each of the second and third panels.

29. The blank as defined in claim 28, wherein the at least one second marking is disposed on one of the first panel and a fourth panel and in a region intermediate the fourth horizontal fold line and the second edge.

30. The blank as defined in claim 29, wherein the plurality of visual indicators further includes the at least one third marking disposed on the first panel in a region proximate the third horizontal fold line and intermediate the first score line and the third horizontal fold line.

31. The blank as defined in claim 30, wherein the plurality of visual indicators further includes a fourth marking disposed on the other of the first and fourth panels and intermediate the fourth fold line and the second edge; and wherein the fourth marking includes a series of graphics and text suggestive as to how to collapse a container constructed from the blank.

* * * * *